US005299741A

United States Patent [19]

Murphy

[11] Patent Number: 5,299,741

[45] Date of Patent: Apr. 5, 1994

[54] TEXTURE SPRAY GUN BLEED VALVE

[75] Inventor: Edward P. Murphy, Blaine, Minn.

[73] Assignee: Graco Inc., Minneapolis, Minn.

[21] Appl. No.: 983

[22] Filed: Jan. 6, 1993

[51] Int. Cl.[5] ..... B05B 7/04

[52] U.S. Cl. ..... 239/124; 239/528

[58] Field of Search ..... 239/290-292, 239/300, 301, 526, 124, 528

[56] References Cited

U.S. PATENT DOCUMENTS

| | | | |
|---|---|---|---|
| 1,919,153 | 7/1933 | Andrews | 239/290 X |
| 1,962,911 | 6/1934 | Roseland | 239/301 |
| 2,060,894 | 11/1936 | Potter | 239/301 |
| 2,708,095 | 5/1955 | Mitchell | 239/300 X |
| 2,864,649 | 12/1958 | Adams | 239/300 |
| 3,227,377 | 1/1966 | Bartel | 239/124 |

*Primary Examiner*—Andres Kashnikow
*Assistant Examiner*—Kevin Weldon
*Attorney, Agent, or Firm*—Douglas B. Farrow

[57] ABSTRACT

A spray gun is designed for use with a texture pumping unit which requires of air through the spray gun in order to start the pump. A bleed valve is provided which alternatively directs air to the front of the gun or may be bled to the outside to allow the pumping unit to operate without the gun actually spraying atomized material.

1 Claim, 2 Drawing Sheets

TEXTURE SPRAY GUN BLEED VALVE

BACKGROUND OF THE INVENTION

Elastomeric and acoustic materials are popular for use as architectural coatings. One such pumping unit for applying such materials is shown in my U.S. patent application Ser. No. 07/901,527, filed Jun. 19th, 1992 (the contents of which are hereby incorporated by reference). In this unit, the fluid pumping mechanism is triggered by the flow of air through the hose and into the gun.

SUMMARY OF THE INVENTION

Under certain circumstances, it is desired to be able to operate the pumping assembly in order to adjust engine speed and other parameters without actually atomizing the material coming out of the front of the gun. Hence it is desired to provide a mechanism to allow air flow through the gun but yet to be able to vent the air to the outside without causing the material to be atomized. In this situation the material comes out of the gun as an easily measurable or recoverable stream.

It is therefore an object of this invention to provide such a mechanism and even more ideally to provide such a mechanism as may be retrofitted to existing spray guns where desired.

Toward that end, the spray gun housing has first and second passages therein, the first passage receiving compressed air from the hose in the source and the second passage leading to the front of the gun. Inserted into this housing is an insert which contains a valve member and a knob.

Located at the front end of the valve member is an area having a first diameter and located closely behind that is a second diameter which is reduced relative to the first diameter. Thus, when the valve member is threaded into the first position, air may pass directly from the first passage into the second passage.

When the valve member is moved to the second position, the first diameter seals off the second passage and allows air to pass from the first passage through the second diameter and into an interior axial passage in the valve member and through an exit passage at the rear of the valve member adjacent to the hand adjustment knob. Interior o-ring seals assist in the sealing and allow an ease of manufacturability in assembly of the device.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
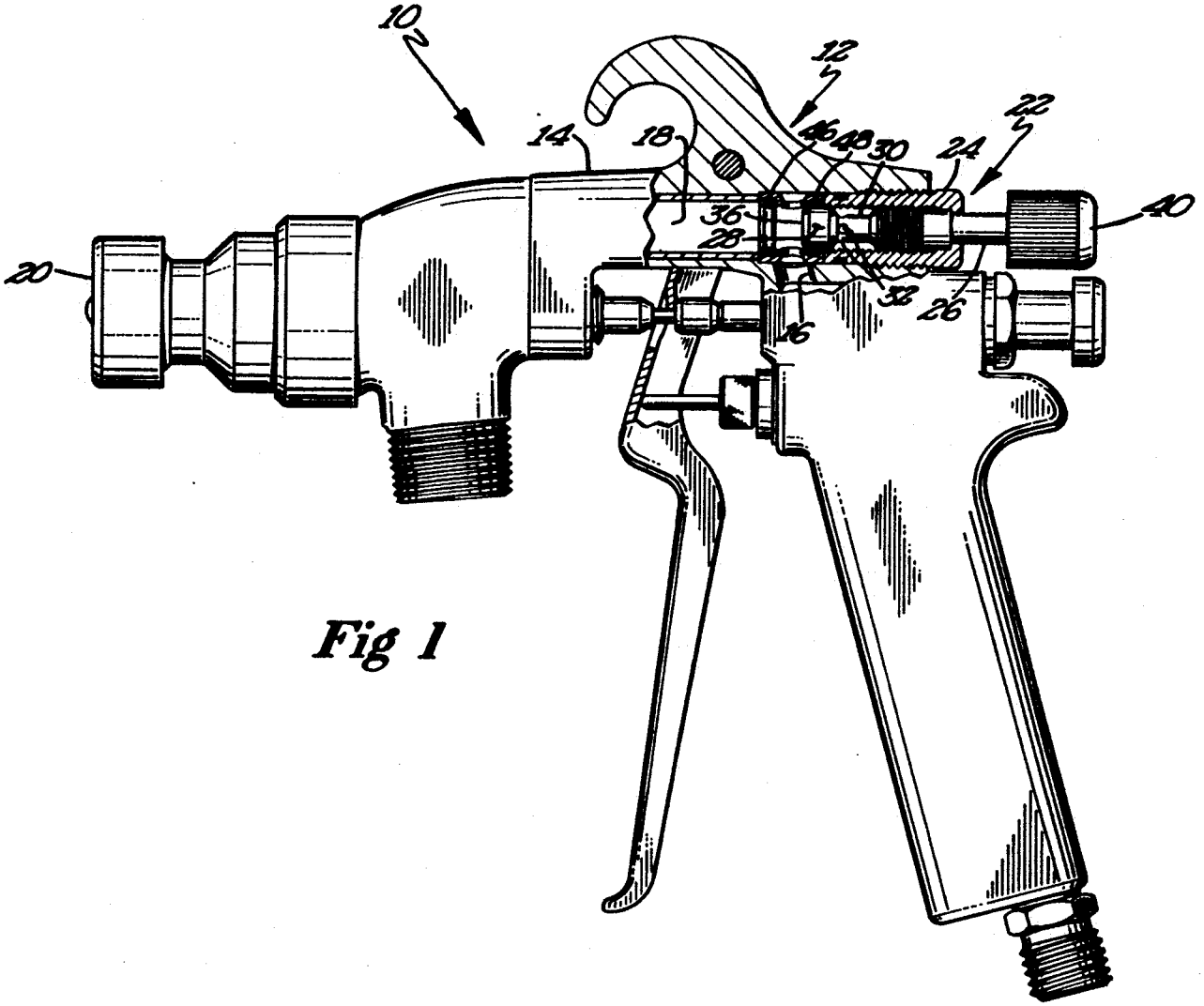
FIG. 1 is a cross-sectional view of a spray gun utilizing the instant invention.

The instant invention generally designated 10 is comprised of a spray gun 12 having a housing 14. Housing 14 has first and second passages 16 and 18 respectively. First passage 16 can be attached to a source of compressed air, while second passage 18 leads to the front end 20 of spray gun 12.

Bleed assembly 22 is comprised of an insert 24 which may be threadedly inserted into housing 14 and valve member 26 which is threadedly engaged in the interior of insert 24. Valve member 26 has a first diameter 28 on the front end thereof and a second smaller diameter 30 spaced rearwardly therefrom. Second diameter 30 has entry passages 32 therein which connect with an interior axial passage 34 which runs from the first end 36 of valve member 26 to the rear or second end 38 of valve member 26.

A knob 40 is located at the rear end of valve member 26 and is provided with a countersunk recess 42 which allows air passing through passageway 34 to exit through exit passages 44 to the outside.

Figure 3:
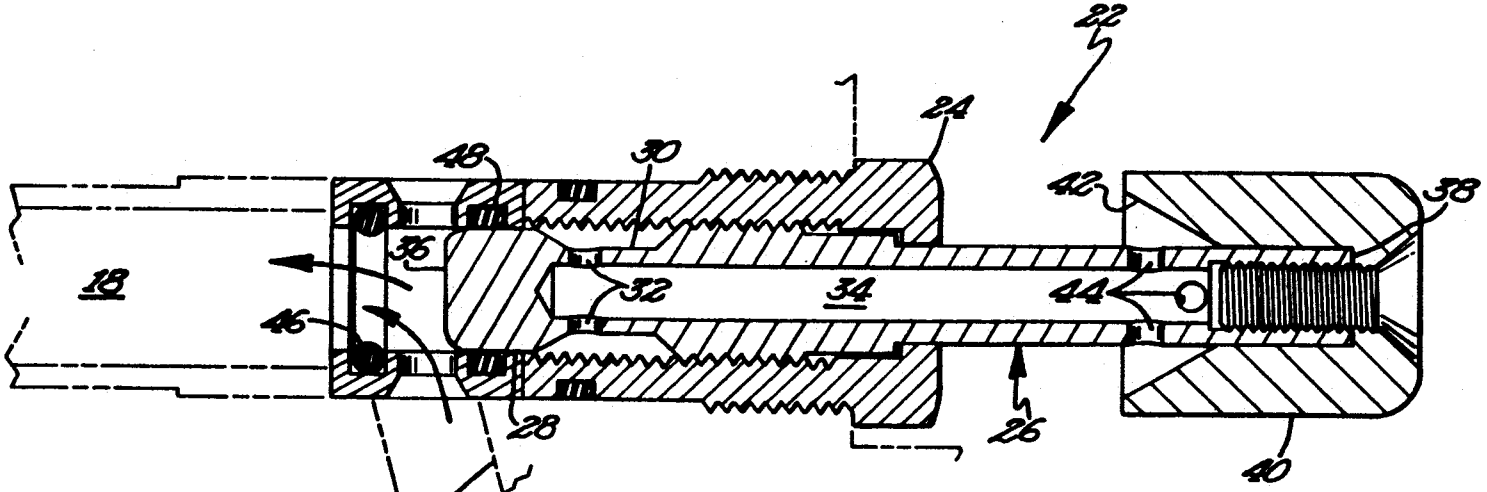
FIG. 3 is a cross-sectional view of the bleed valve assembly showing the valve in the first position.

In operation, in the normal operating position (also referred to as the first position) shown in FIG. 3, knob 40 is rotated to retract valve member 26 such that first diameter 28 seals against seal 48 which allows air to pass directly from first passage 16 through second passage 18 and then to the front end 20 of spray gun 12. The air flow is indicated by the arrows in FIG. 3. Of course, the valve member may be positioned intermediate the two positions to provide varying amounts of atomizing air.

Figure 2:
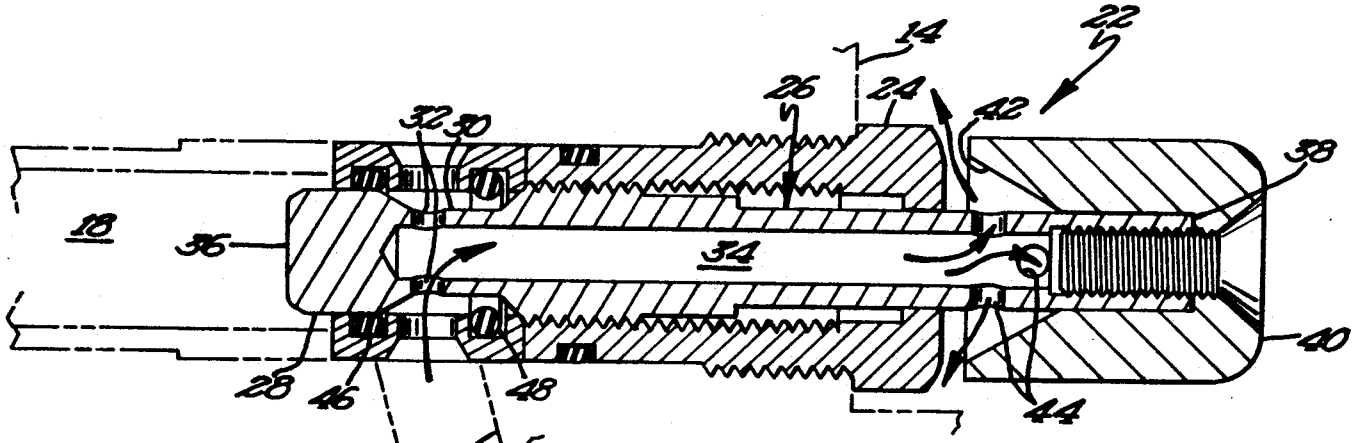
FIG. 2 is a cross-sectional view of the bleed valve assembly showing the valve in the second position.

When it is desired to operate the pumping unit without atomizing material, knob 40 is rotated to screw the assembly 22 into the second position shown in FIG. 2 whereupon first diameter 28 engages seal 46 thereby allowing air from first passage 16 to pass as shown in direction of the arrows through passages 32, 34 and 44 and then to outside the gun. The air flow is indicated by the arrows in FIG. 2.

It is contemplated that various changes and modifications may be made to the spray gun without departing from the spirit and scope of the invention as defined by the following claims.

What is claimed is:

1. A spray gun for connection to a source of compressed air, said spray gun having a tip and further comprising:

a housing comprising a first passage connected to said compressed air source and a second passage connected to said tip; and a valve member in said housing, said valve member comprising:

first and second ends;

an axial passage extending from adjacent said first end to said second end;

a first diameter adjacent said first end;

a second diameter less than said first diameter and located intermediate said first diameter and said second end, said second diameter having inlets communicating with said axial passage and wherein said valve member is movable between first and second positions whereby said first position allows compressed air to pass from said first passage to said second passage and wherein said second position, said first end blocks said second passage thereby connecting said first passage with said axial passage to vent said compressed air.

* * * * *